United States Patent [19]

Pelchat et al.

[11] 4,266,321

[45] May 12, 1981

[54] HINGE AND HOLD-OPEN ASSEMBLY

[75] Inventors: Paul F. Pelchat, Canton; Alfonsas Arlauskas, Troy, both of Mich.

[73] Assignee: General Motors Corporation, Detroit, Mich.

[21] Appl. No.: 50,186

[22] Filed: Jun. 20, 1979

[51] Int. Cl.[3] ..... E05D 11/10

[52] U.S. Cl. ..... 16/145

[58] Field of Search ..... 16/145, 142, 139, 146, 16/180

[56] References Cited

U.S. PATENT DOCUMENTS

| | | | |
|---|---|---|---|
| 3,065,497 | 11/1962 | Faber | 16/142 |
| 3,096,538 | 7/1963 | De Rees | 16/142 |
| 3,370,317 | 2/1968 | Marchione | 16/145 |
| 3,371,374 | 3/1968 | Marchione | 16/145 |
| 3,431,588 | 3/1969 | Frey | 16/145 |
| 3,431,589 | 3/1969 | Frey | 16/145 |
| 3,434,179 | 3/1969 | Marchione | 16/145 |
| 3,438,083 | 4/1969 | Kirk | 16/139 |
| 3,550,185 | 12/1970 | Marchione | 16/145 |
| 3,729,777 | 5/1973 | Marchione | 16/145 |
| 3,820,192 | 6/1974 | Nakano et al. | 16/145 |
| 3,837,040 | 9/1974 | Kellen et al. | 16/145 |
| 3,870,361 | 3/1975 | Krause | 16/145 |
| 3,889,316 | 6/1975 | Koike | 16/145 |

FOREIGN PATENT DOCUMENTS 1340725 12/1973 United Kingdom .

*Primary Examiner*—H. Hampton Hunter
*Attorney, Agent, or Firm*—R. L. Phillips

[57] ABSTRACT

A hinge and hold-open assembly is disclosed having a pair of hinge straps and an integral hold-open spring and pivot pin member. The spring and pin member has a pivot pin portion pivotally connecting the hinge straps and a spring portion which is operatively engaged by a cam on one of the hinge straps so as to be normally relaxed in a closed hinge condition. Then on relative pivotal movement between the hinge straps, the spring portion is radially flexed and then relatively abruptly partially unflexed to yieldingly establish and hold an open hinge condition and with less effort required to establish the hold-open condition than is required to release same.

3 Claims, 5 Drawing Figures

HINGE AND HOLD-OPEN ASSEMBLY

This invention relates to hinge and hold-open assemblies and more particularly to a hinge and hold-open assembly having an integral hold-open spring and pivot pin member.

The hinge and hold-open assembly of the present invention is a relatively simple, lightweight arrangement which is particularly useful for vehicle door applications in both hinging the door on the vehicle body and providing one or more spring held hold-open door positions. In the preferred embodiment of the present invention, there is provided a pair of hinge straps and an integral hold-open spring and pivot pin member having a pivot pin portion and a spring portion which is deflected in a radial direction relative to the pin portion. A single pivot hole in each hinge strap receives the pin portion of the integral spring and pin member and cooperates therewith to connect the hinge straps for relative pivotal movement between a closed condition and an open condition to provide for closing and opening the door. On the other hand, a slot in one of the hinge straps receives the spring portion to prevent turning of the integral spring and pin member relative to this hinge strap while permitting radial deflection of the spring portion relative to the pin portion. A rotary cam follower is rotatably mounted on the spring portion and a cam is formed on the other hinge strap and has a gradually inclined portion for guiding the cam follower to force gradual radial deflection of the spring portion from a normally relaxed condition in the closed hinge condition during relative pivotal movement of the hinge straps to the open hinge condition. The cam has a detent portion which permits relatively abrupt but limited radial unflexure of the spring portion upon the hinge assuming its open condition to thereby yieldingly hold the hinge in this condition and thereby the door in its open position and wherein less effort is required to operate the hinge to establish its hold-open condition than is required to release same. In addition, there may be provided an intermediate detent portion on the cam to similarly yieldingly hold the hinge straps in an intermediate hold-open condition and thereby the door in a partially open position with again less effort being required to establish such hold-open hinge condition than is required to release same to re-establish the closed door position and also to establish the fully open door position.

The primary object of the present invention is to provide a new and improved hinge and hold-open assembly.

Another object is to provide a new and improved hinge and hold-open assembly having an integral hold-open spring and pivot pin having a spring portion thereof which is normally relaxed in a closed hinge condition and is first radially flexed and then partially unflexed to yieldingly establish and hold an open hinge condition and wherein less effort is required to establish the hold-open hinge condition than is required to release same.

Another object is to provide a hinge and hold-open assembly having an integral hold-open spring and pivot pin member providing a pivotal connection at a pivot pin portion thereof between the hinge members and wherein a hold-open spring portion thereof is limited to radial deflection relative to the hinge axis by one of the hinge members and has a cam follower rotatably mounted thereon engageable with a cam on the other hinge member to force gradual radial deflection of the spring in one direction from a normally relaxed condition in a closed hinge condition during relative pivotal movement of the hinge members to an open hinge condition and wherein the cam has a detent to permitting relatively abrupt but limited radial unflexure of the spring portion when the hinge members assume the open hinge condition to yieldingly hold this condition and with less effort being required to establish this condition then is required to release same.

These and other objects of the present invention will be more apparent from the following specification and drawings wherein.

Figure 1:
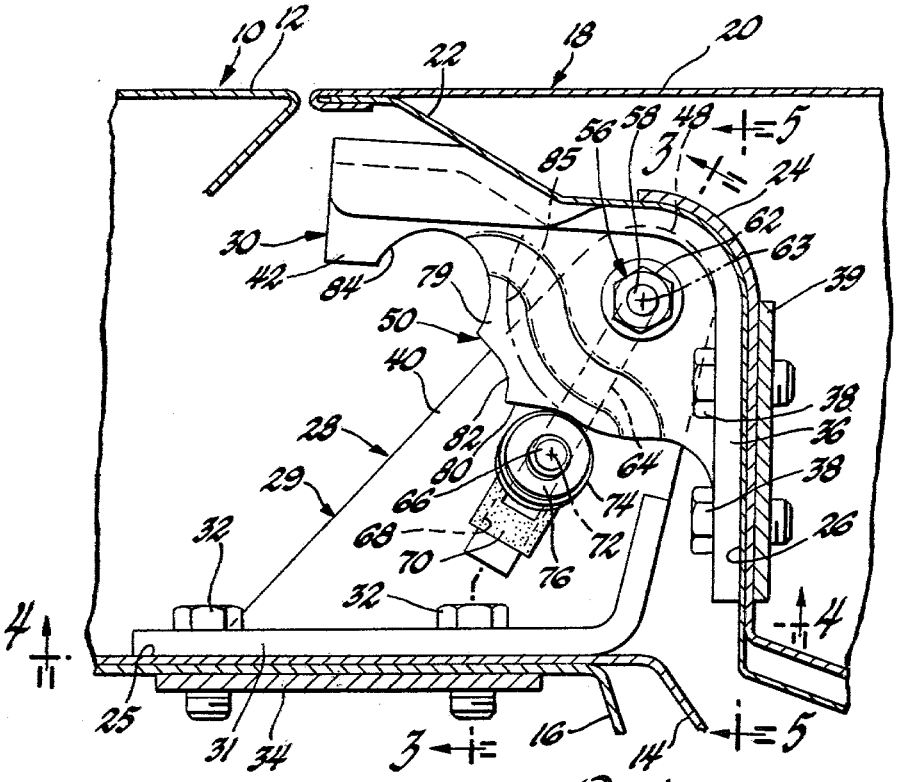
FIG. 1 is a sectional view, looking downward, of a portion of a vehicle body and a door with the door swingably mounted on the vehicle body for movement between open and closed positions by a hinge and hold-open assembly according to the present invention, the door being shown in the closed position.

Referring to FIG. 1, there is shown a vehicle body 10 having a front fender panel 12 and a front door support located inward thereof comprising a front hinge pillar 14 and a hinge pillar reinforcement member 16 which extends along the hinge pillar on the side thereof opposite that to which the hinges are attached. This vehicle body structure together with other structure, not shown, defines a front door opening in which a front door 18 is swingably mounted on the hinge pillar. The door 18 comprises an outer panel 20, an inner panel 22 which is joined therewith and a hinge reinforcement member 24 inside the door which extends along the inner panel on the side thereof opposite that to which the hinges are attached. Furthermore, it will be seen that the hinge pillar 14 provides for attachment of the hinges thereto on a flat surface 25 thereof extending parallel to and behind the front fender panel 12 while the inner door panel 22 provides for attachment of the hinges thereto on a flat surface 26 thereof extending transverse to and along this end of the door and behind the outer door panel 20.

The door 18 is swingably mounted on the hinge pillar by two hinges, one being at an upper location and of a conventional type (not shown) and the other being at a lower location and constructed according to the present invention of which the preferred embodiment thereof is shown and designated as 28. With such hinge connections, the door 18 is swingable from the closed position shown in FIG. 1 where it closes the door opening in the vehicle body to the partially open or intermediate position shown in solid line in FIG. 2 and finally to the full open position shown in the phantom line in the latter figure.

Figure 2:
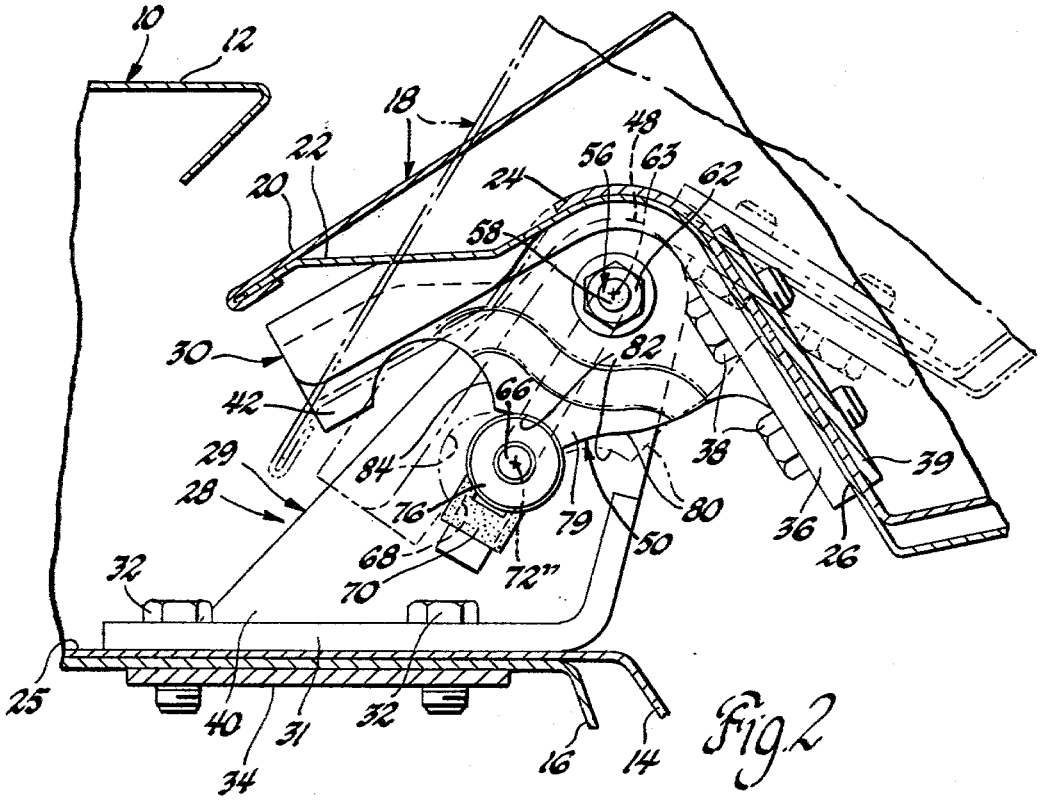
FIG. 2 is a view similar to FIG. 1 showing the door in a partially open position in solid line and in a fully open position in phantom line.

The hinge and hold-open assembly 28 in addition to providing the lower hinge connection between the door and the vehicle body also operates to releasably hold the door 18 in the partial and full open positions shown in FIG. 2. The hinge and hold-open assembly 28 comprises a pair of hinge straps; namely a body hinge strap 29 and a door hinge strap 30. The body hinge strap 29 has a flat base 31 that is fixed to the hinge pillar 14 and hinge pillar reinforcement member 16 against the flat hinge pillar surface 25 by bolts 32 and an anchor plate 34 to which the bolts are threaded, the anchor plate being forced thereby against the pillar reinforcement member. Similarly, the door hinge strap 30 has a flat base 36 that is fixed to the inner door panel 22 and reinforcement member 24 against the flat inner door panel surface 26 at this end of the door by bolts 38 and an anchor plate 39 to which the bolts are threaded, the anchor plate being forced thereby against the reinforcement member 24.

Figure 3:
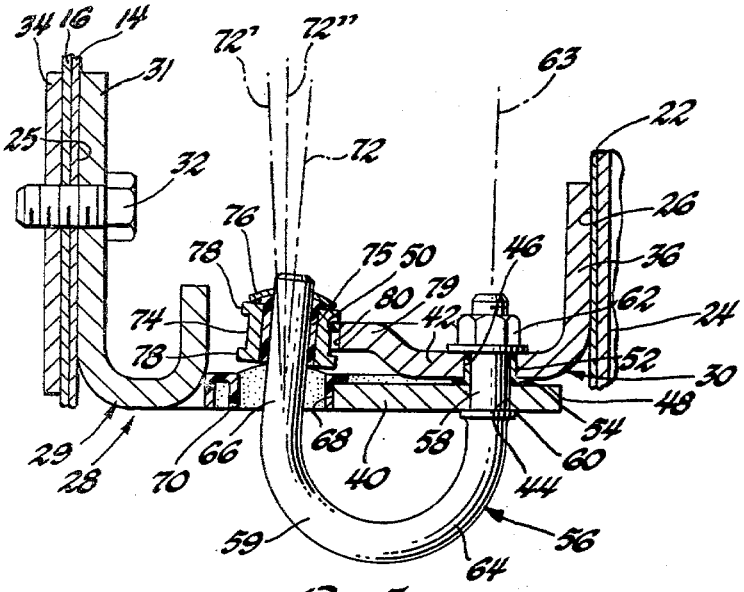
FIG. 3 is a view taken along the line 3—3 in FIG. 1.
Figure 4:
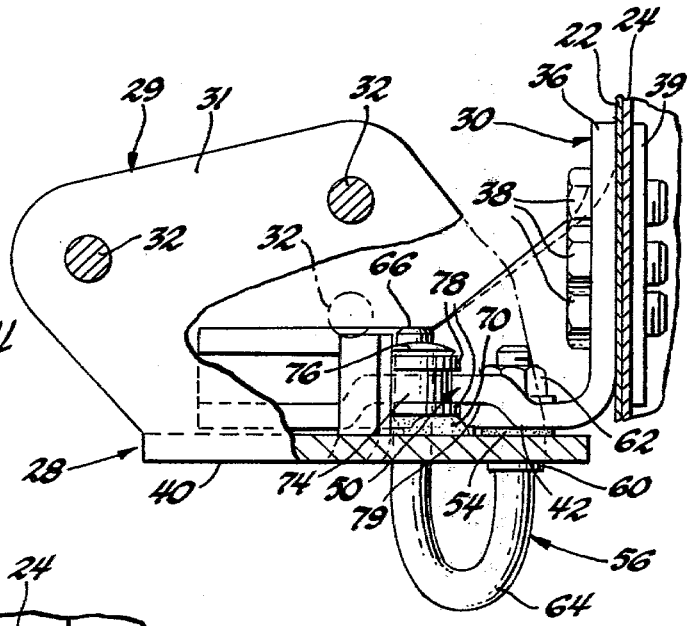
FIG. 4 is a view taken along the line 4—4 in FIG. 1.
Figure 5:
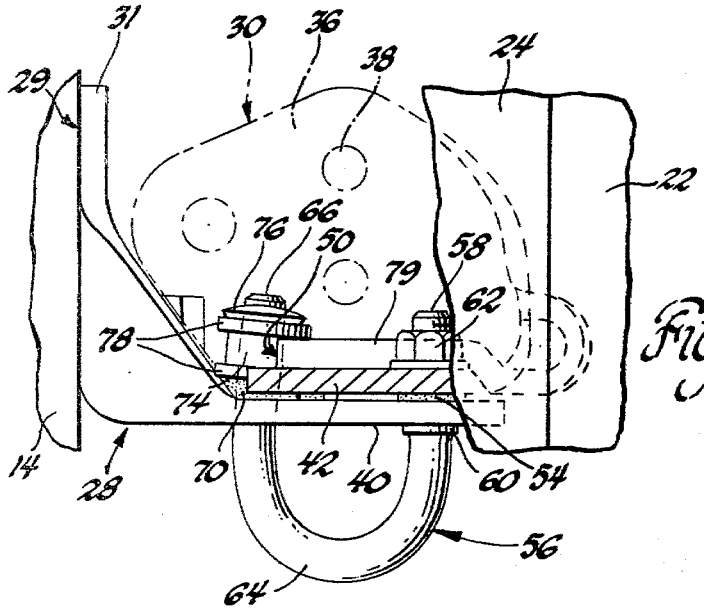
FIG. 5 is a view taken along the line 5—5 in FIG. 1.

The hinge straps 29 and 30 have a single leg 40 and 42 extending at right angles from their respective bases 31 and 36 as can be seen in FIG. 3. The legs 40 and 42 extend relative to each other in overlapping, side-by-side relationship and have a hinge hole 44 and 46, respectively, where they overlap. The hinge hole 44 in the body hinge strap leg 40 is located adjacent the end 48 thereof while the hinge hole 46 in the door hinge strap leg 42 is oppositely located, adjacent the base 36 of this hinge strap and remote from an edge surface 50 of the leg 42 to provide for hold-open operation as described later. A bushing 52 is mounted in the hinge hole 46 of the door hinge strap which is enlarged for this purpose and the bushing has an integral shoulder 54 which is sandwiched between the two hinge strap legs 40 and 42 whereby they are spaced slightly apart. The two hinge strap legs 40 and 42 are pivotally joined or connected by an integral hold-open spring and pivot pin member 56 hereinafter referred to as simply a spring and pin member.

The spring and pin member 56 has a circular cross-section and a U-shape with one leg having a short, straight end portion 58 providing a pivot pin for the hinge assembly and the remaining J-shaped portion 59 which includes the other leg providing a spring for hold-open operation. Describing first the pivot pin connection, the spring and pin member 56 has an integral shoulder 60 adjacent the pin portion 58 which engages the outer side of the body hinge strap leg 40 while the pin portion 58 extends through the hole 44 in this leg and the bushing 52 in the door hinge strap leg 42. The pin portion 58 is secured in place by being threaded at the end thereof to accept a nut 62 with an integral washer which engages the outer side of the door hinge strap leg. Thus, the hinge straps 29 and 30 are pivotally connected by the pivot pin portion or leg 58 of the spring and pin member 56 at a single location for relative swinging movement about the hinge axis 63 thus provided.

Describing now the hold-open arrangement, the single bight 64 of the spring and pin member 56 which forms part of the J-shaped spring portion 59 thereof is located on the outer side of the body hinge strap leg 40 and the remaining straight section 66 of the spring portion extends through a slot 68 in the body hinge strap leg and then alongside the edge surface 50 of the door hinge strap leg 42. The slot 68 has a rectangular shape which is radially aligned along its long sides with the hinge axis 63 and is lined with an anti-friction liner 70 which engages opposite sides of the straight spring section 66 remote from the end thereof. The long sides of the liner 70 prevent turning of the spring and pin member 56 relative to the body hinge strap leg 40 while permitting relatively silent radial deflection of the straight spring portion 66 relative to the pin portion 58 and the hinge axis 63 it provides including the center-line positions 72, 72' and 72'' shown in FIG. 3.

A rotary cam follower 74 with a bushing 75 is rotatably mounted on the straight section or leg 66 of the spring portion 59 near the end thereof and is retained thereon by engaging at one side with a raised portion of the liner 70 and on the other side with a push-on retainer 76 that is pushed on the end of the straight spring section. The cam follower has radial shoulders 78 at the opposite ends thereof which extend past the edge surface 50 of the door hinge strap leg 42 and along the opposite sides thereof, the leg 42 having an offset portion 79 including the edge surface 50 which is offset from the other leg 40 to accommodate the cam follower for movement along this edge surface while the shoulders 78 on the cam follower assure that the cam follower does not depart off the track thereof.

The edge surface 50 of the door hinge strap leg 40 serves as a cam surface which is engaged by the cam follower 74 to provide hold-open operation in both the partial door open position shown in solid line FIG. 2 and the full door open position shown in phantom line in FIG. 2. For this purpose, the cam surface 50 is formed with three distinct lobe portions 80, 82 and 84 having a base circle 85 whose center is on the hinge axis 63 as seen in FIGS. 1 and 2. The first lobe portion 80 provides for both relaxation of the spring portion 59 in the closed door position and flexure thereof as the door is opened whereas the remaining two lobe portions 82 and 84 serves as detents wherein the spring portion is permitted to only partially unflex. The bottom point of lobe portion 80 is on the base circle 85 and is determined so that this lobe portion is not engaged by the cam follower 74 when the door is closed as shown in FIG. 1 so that the spring portion 59 of the spring and pin member 56 is not then flexed and thus in a normally fully relaxed condition with the straight spring portion 66 at position 72. The lobe portion 80 is provided with a gradually increasing ramp angle so that as the door is opened, this lobe portion is then engaged by the cam follower 74 whereafter the cam follower is caused to roll therealong and gradually deflect the spring portion 59 radially away from the hinge axis. This action continues until the cam lobe portion 82 is reached at which point the straight spring portion 66 will have reached its maximum outward deflection and be in position 72'. The lobe portion 82 includes a convex profile and is located along the cam surface 50 intermediate lobe portions 80 and 84 so that when the door reaches the desired partially open or intermediate position shown in solid line in FIG. 2, the thus loaded spring portion 59 is then permitted to partially unflex while forcing the cam follower 74 to roll into the convex pocket that the lobe portion 82 provides. The bottom point of lobe portion 82 is located a predetermined distance radially outward of the base circle 85, such as half the lift of the lobe portion 80, to thus limit unflexure of the spring portion 59 with the straight section 66 thereof retained at position 72'' which is intermediate its fully relaxed position 72 and its fully flexed position 72' to thereby yieldingly hold the door in the partial open position when the door opening force is removed. In addition, the entrance angle of lobe portion 82 is steeper than the exit angle of lobe portion 80 so that less effort on the door is required to establish this partially open door position than is required to release same to close the door.

The exit angle of lobe portion 82 like that of lobe portion 80 is gradual and its lift is the same so that with the door in the detented partially open position and then on door movement toward its full open position, the intermediately located lobe portion 82 gradually forces outward radial deflection of the straight spring section 66 until the cam lobe portion 84 is reached at which time the straight spring section is again at its maximum deflected position 72'. The lobe portion 84 has a convex profile and is located along the cam surface 50 so that when the door reaches the desired fully open position shown in phantom line in FIG. 2, the thus loaded spring portion 59 is then permitted to relatively abruptly partially unflex while forcing the cam follower 74 to roll into the convex pocket that the lobe portion 84 provides. The bottom point of lobe portion 84, like lobe portion 82, is located radially outward of the base circle 85 a distance such as half the maximum radial deflection of the straight spring section 66 to thus limit unflexure thereof by retaining it again at position 72'' to thereby yieldingly hold the door in its fully open position when the door opening force is removed. And like the establishment and release of the intermediate hold-open position, the entrance angle of lobe portion 84 is steep as compared to the ramp angle leading thereto on the intermediate lobe portion 82 so that less effort is required to establish the full hold-open condition that is required to release same and return the door first to the intermediate hold-open position and thereafter to the closed position.

Thus, it will be appreciated that in the preferred embodiment of the present invention, the spring portion of the spring and pin member is not stressed when the door is in its closed position which is the majority of the time. Then on opening the door, the spring portion is gradually radially deflected and then permitted to relatively abruptly partially unflex to first yieldingly hold the intermediate door open position and then the full open door position as selected by the person operating the door. Furthermore, while the door is yieldingly held by the thus slightly relaxed or partially unflexed spring portion in each of the hold-open positions, a greater force is then required to release the door from each hold-open position than was required to establish same. And in the case of the intermediate hold-open position, the latter is true whether the door is then returned to its closed position or further opened to its detented fully open position.

The above described preferred embodiment is illustrative of the invention which may be modified within the scope of the appended claims.

The embodiments of the invention in which an exclusive property or privilege is claimed are defined as follows:

1. A hinge and hold-open assembly comprising a pair of hinge straps, an integral hold-open spring and pivot pin member having a pivot pin portion and a spring portion, means on said hinge straps for cooperating with said pin portion to pivotally connect said hinge straps for relative pivotal movement between a closed condition and an open condition, means on one of said hinge straps for preventing turning of said spring and pin member relative to said one hinge strap while permitting radial deflection of said spring portion relative to said pin portion, a rotary cam follower rotatably mounted on said spring portion, and cam means on the other of said hinge straps for guiding said cam follower, said cam means including a first lobe portion for establishing said spring portion in a relaxed condition when said hinge straps are in their closed condition and forcing gradual radial deflection of said spring portion in one direction during relative pivotal movement of said hinge straps to their open condition, said cam means further including a second lobe portion with a convex profile for guiding said cam follower to permit relatively abrupt but limited radial unflexure of said spring portion in the opposite direction upon the hinge straps assuming their open condition to thereby yieldingly hold the hinge straps in their open condition and whereby less effort is required to establish the hold-open condition then is required to release same.

2. A hinge and hold-open assembly comprising a pair of hinge straps, an integral hold-open spring and pivot pin member having a pivot pin portion and a spring portion, means on said hinge straps for cooperating with said pin portion to pivotally connect said hinge straps for relative pivotal movement between a closed condition and an open condition, means on one of said hinge straps for preventing turning of said spring and pin member relative to said one hinge strap while permitting radial deflection of said spring portion relative to said pin portion, a rotary cam follower rotatably mounted on said spring portion adjacent the end thereof, and cam means on the other of said hinge straps for guiding said cam follower, said cam means including a first lobe portion for establishing said spring portion in a relaxed condition when said hinge straps are in their closed condition and forcing gradual radial deflection of said spring portion at the end thereof in one direction during relative pivotal movement of said hinge straps to their open condition, said cam means further including a second lobe portion with a convex profile for guiding said cam follower to permit relatively abrupt but limited radial unflexure of said spring portion at the end thereof in the opposite direction upon the hinge straps assuming their open condition to thereby yieldingly hold the hinge straps in their open condition and whereby less effort is required to establish the hold-open condition than is required to release same.

3. A hinge and hold-open assembly comprising a pair of hinge straps, an integral hold-open spring and pivot pin member of U-shape having a relatively short straight pivot pin portion and a J-shaped spring portion with a relatively long straight section, means on said hinge straps for cooperating with said pin portion to pivotally connect said hinge straps for relative pivotal movement between a closed condition and an open condition, said long straight section extending through a slot in one of said hinge straps whereby said spring and pin member is prevented from turning relative to said one hinge strap while radial deflection of said long straight section is permitted relative to said pin portion, a rotary cam follower rotatably mounted on said long straight section adjacent the end thereof, and cam means on the other of said hinge straps for guiding said cam follower, said cam means including a first lobe portion for establishing said spring portion in a relaxed condition when said hinge straps are in their closed condition and forcing gradual radial deflection of said long straight section away from said pin portion during relative pivotal movement of said hinge straps to their open condition, said cam means further including a second lobe portion with a convex profile for guiding said cam follower to permit relatively abrupt but limited radial unflexure of said long straight section toward said pin portion upon the hinge straps assuming their open condition to thereby yieldingly hold the hinge straps in their open condition and whereby less effort is required to establish the hold-open condition than is required to release same.

* * * * *